United States Patent [19]

Cunningham

[11] 4,445,711

[45] May 1, 1984

[54] COLOR-CODED NUMERIC OR ALPHABETIC FILING SYSTEM

[76] Inventor: Walter F. Cunningham, 1370 W. Hampton Pl., Palatine, Ill. 60067

[21] Appl. No.: 193,438

[22] Filed: Oct. 2, 1980

[51] Int. Cl.[3] ..... B42D 15/00

[52] U.S. Cl. ..... 283/1 R; 283/39; 283/81

[58] Field of Search ..... 40/23 A; 283/1 R, 36, 283/18, 21, 62, 37, 38, 39, 40, 41, 42, 43, 81

[56] References Cited

U.S. PATENT DOCUMENTS

| | | | |
|---|---|---|---|
| 3,303,080 | 2/1967 | Aguilera | 283/36 X |
| 3,805,426 | 4/1974 | Cunningham | 283/41 X |
| 3,937,493 | 2/1976 | Fasbender | 283/41 |
| 4,050,719 | 9/1977 | Cunningham | 40/23 A X |

FOREIGN PATENT DOCUMENTS

| | | | |
|---|---|---|---|
| 417055 | 8/1925 | Fed. Rep. of Germany | 283/36 |
| 542419 | 1/1932 | Fed. Rep. of Germany | 283/36 |
| 910364 | 6/1946 | France | 283/36 |

*Primary Examiner*—Paul A. Bell
*Attorney, Agent, or Firm*—Gerald S. Geren

[57] ABSTRACT

There is disclosed herein a color-coded filing system for uniquely identifying documents to be filed and retrieved. The document to be filed has sequential filing characters applied along the top and side edges thereof. Marker tabs are provided which are pressure sensitive, adhesive-backed and transparent and have a colored peripheral border that defines a two-position transparent aperture. A positively applied filing character is provided in the first position of the tab aperture and the second position of the marker tab is blank. The marker tabs can be applied over the filing characters on said document so that the characters on the document appear in the second position of said aperture next to the characters on the tab. Both characters are of a similar size, color and shape so as to provide a unique and visually acceptable identification for said document. The filing characters can be either numerals or letters which can be used on the top or side edge of the document for drawer or shelf filing.

26 Claims, 10 Drawing Figures

FIG. 8
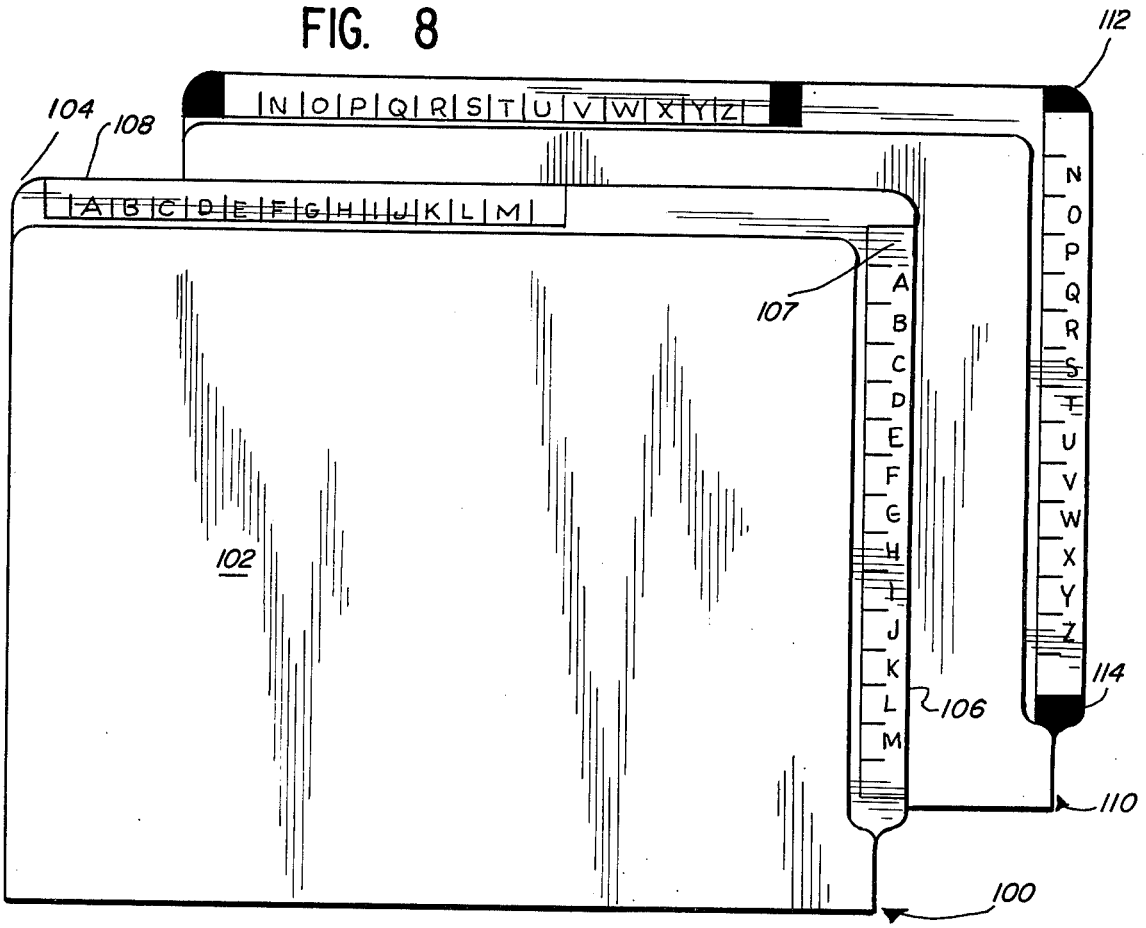
FIG. 9
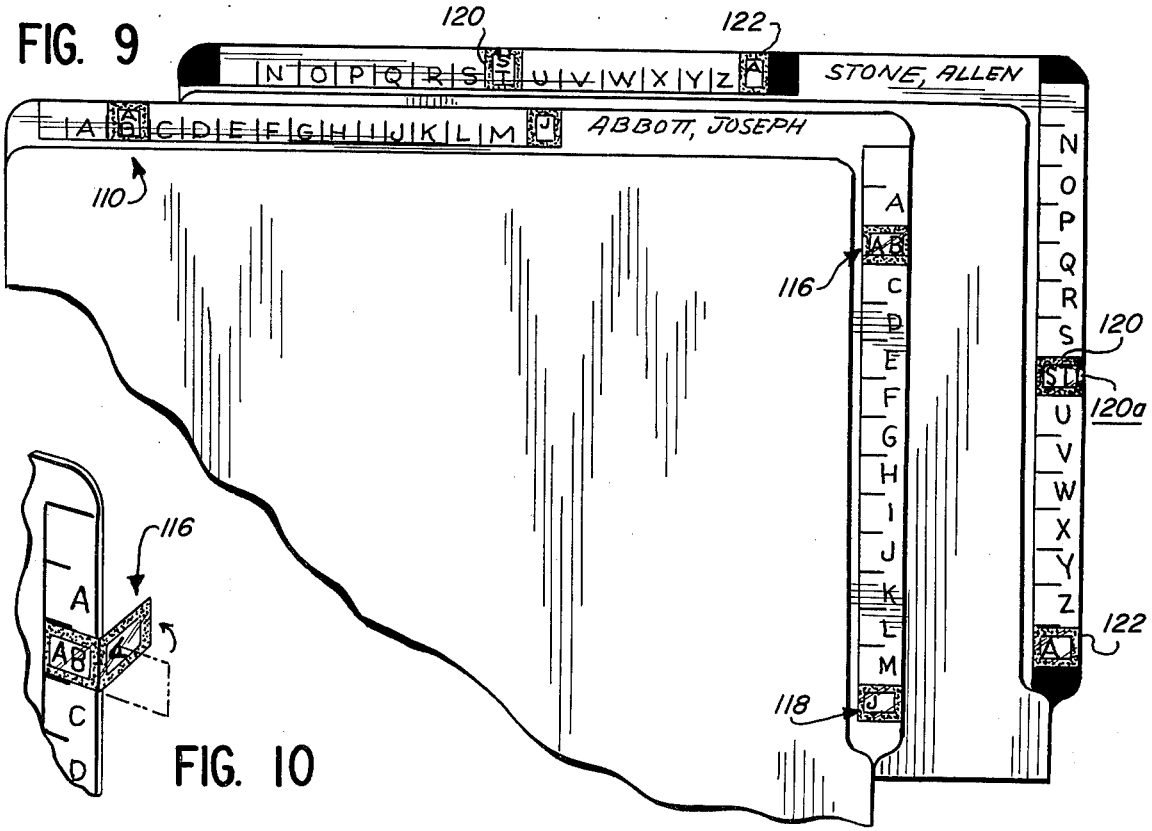
FIG. 10

COLOR-CODED NUMERIC OR ALPHABETIC FILING SYSTEM

BACKGROUND OF THE INVENTION

This invention relates to filing systems, and more particularly, to a system for use in filing and retrieving documents which employes colors, characters and positions to uniquely identify the documents to be filed.

Many systems exist for filing and retrieving documents from file drawers or from filing shelves. These systems are used with file folders within which individual documents are stored, on individual documents, on index cards, on microfiche cards, etc. The term "document" as used herein refers to any of the foregoing which are to be identified for filing purposes. Color-coding systems have been developed for locating and retrieving documents, as well as for minimizing misfiling.

U.S. Pat. No. 4,050,719 discloses a numerical color-coded system for use in shelf-type filing systems.

Although shelf-type filing systems are becoming increasingly popular, due to many space-saving features, the vast majority of filing is still done in filing cabinets which employ roll-out drawers. It is therefore desirable to provide a numerical color-coding system for use with documents which are filed in both shelves or in roll-out drawers.

In addition to the numeral filing systems, there are many situations in which alphabetic filing systems are used.

In the existing color-coding systems, colored marker tabs are provided which have an adhesive backing on one side with the other side being printed in a fashion whereby a reverse or transparent numeral and a transparent window are provided adjacent each other. The tab is then applied over a document having numerals printed thereon so that the numeral appears in the window. Although such systems clearly identify and mark the file, it has been observed that reading the reverse numeral in conjunction with a positive numeral appearing in the window presents some visual difficulties. It is therefore desirable to provide an improved tab which presents a visually improved image.

These and other objects of this invention will become apparent from the following description and the appended claims.

SUMMARY OF THE INVENTION

There is provided by this invention an improved numerical color-coded filing system in which the documents to be filed have numerals or numeric filing characters along the top edge and at least one side edge and improved marker tabs for placement along the top and side edges of the document. The improved marker tab is foldable, has two sections, each of which includes a colored border or periphery which surrounds a large transparent central area on which a numeral is positively printed. Thus when the tab is applied to the document, two positive numerals are seen in the window. One numeral is on the tab and the other is on the document. This arrangement enhances the perception of both numbers.

One numeral is printed on each section of the tab and the numerals are aligned transverse to each other in such a way that the same tab can be used either on the top edge or the side edge of the document to be filed, thereby permitting use on shelves, in drawers, or both.

Furthermore, in this system each of ten thousand documents can be uniquely identified (i.e., 0 to 9999) using only two marker tabs on each document.

There is also provided by this invention a color-coded alphabetic filing system in which letters of the alphabet are provided along the top and side edges of a document to be filed and which can be used in association with marker tabs on which a letter or alphabetic filing character is printed. In connection with the English alphabet, the first thirteen letters of the alphabet are printed on a first document and the second thirteen letters are printed on a second document with blank spaces being provided for additional filings. It is anticipated that this system will be used in countries which use alphabets other than the twenty-six letter English alphabet. This system can also be used both in shelf and drawer filing systems.

BRIEF DESCRIPTION OF THE DRAWINGS

FIG. 8 is a front view of two file folders having English letters printed along the top and right-hand edges;

FIG. 9 is a front view showing two file folders with English letters and marker tabs applied thereon for uniquely identifying particular files; and FIG. 10 is a fragmentary perspective view showing a marker tab being applied to a folder edge.

DESCRIPTION OF THE PREFERRED EMBODIMENT

I. The Color-Coded Numeric Filing System

A. The File Folder

Figure 1:
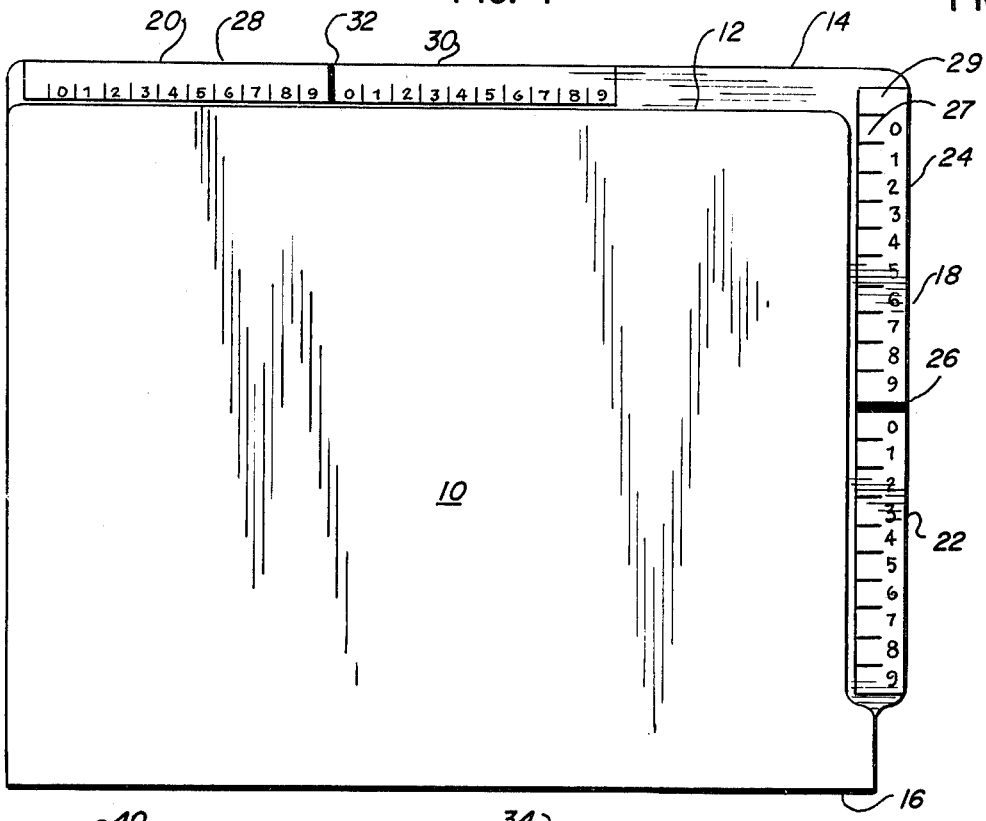
FIG. 1 is a front view of a file folder used in this system and having numerals along the top and right-hand side edges thereof.

Referring now to the drawings and in particular FIG. 1, there is shown a file folder 10 which includes a front panel 12 and a larger back panel 14 with the panels being connected to each other by a fold line 16 along the bottom edge. File folders of this type are useful for holding individual papers and other documents.

However, it will be appreciated that although the filing system described herein refers to file folders, the system can be used with any document which is to be filed, such as index cards, microfiche cards, etc.

The back panel 14 of the file folder 10 includes an enlarged and exposed margin along the right-hand side edge 18 and along the top edge 20. Numerals or numerical filing characters are printed vertically along the right-hand side margin. The numerals form a number bar 21 which includes two sets of numerals 22 and 24. Each set includes the numerals "0"–"9", and sets 22 and 24 are separated by a spacer bar 26. The numerals along the side edge are printed adjacent the edge 18 with a tab numeral space, such as 27, being provided inwardly of the numerals. This defines a two-position space with the first position being blank.

It will be noted that a two-position blank space 29 is provided at the top of the number bar 21.

It is also seen that a number bar 31 having two sets 28 and 30 of numerals "0"–"9" is provided along the top edge of the folder. A spacer bar 32 is printed between the sets. The sets of numerals 28 and 30 are spaced from the top edge 20 so as to define a space between the edge 20 and numerals. This space is referred to as the first position. Thus any numeral "0"–"9" on a tab can fit into the first position to form the two digits "00" to "99".

Figure 2:
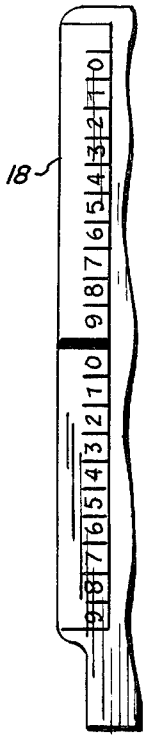
FIG. 2 is a fragmentary view of the folder shown in FIG. 1 showing a second set of numerals along the side edge of the folder.

Referring now to FIG. 2, it will be seen that on the back of the panel 14 and along the edge 18, additional filing numerals are provided which are generally aligned with the numerals in sets 22 and 24 on the front side edge of the back panel. However, two things should be noted. First, the numerals lie in a horizontal attitude rather than a vertical attitude. Next, the numerals are spaced from the edge rather than being adjacent the edge. Thus a blank space is provided in the first position. The horizontal arrangement of the numerals will best be understood in relation to the discussion hereinafter concerning the marker tabs.

As can be seen in FIG. 1, this file folder can be used either in a shelf system where the vertical side edge and numerals are visible, or in a drawer filing where the top edge and numerals are visible. In some situations, it may be desirable to provide marker tabs along both the side and top edges so that if the files are removed from storage, but yet are placed in tub files for refiling, identification in either situation can be had.

B. The Marker Tabs

Figure 3:
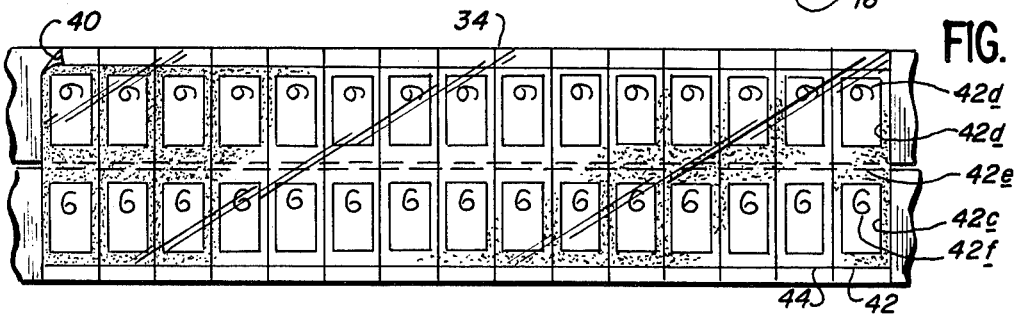
FIG. 3 is a plan view of a section of marker tabs having a colored peripheral border, transparent window and positively printed numeral thereon.

Referring now to FIG. 3, there is shown strip of printed adhesive marker tabs 34.

The strip includes two longitudinally-extending release paper backings 36 and 38. A pressure sensitive, adhesive-backed, printed transparent plastic sheet 40 adheres to the release paper backings 36 and 38. Colored borders and numerals are printed on the sheet and the sheet is perforated transversely so as to define a plurality of identical but separable marker tabs, such as 42, 44 and 46.

Each marker tab has two sections, is printed in a color, such as **42*a*, and the color defines two transparent apertures 42*b* and 42*c* and colored peripheral borders thereabout. In each aperture a filing numeral is positively printed in a style and color to match the folder numerals 22, etc. In this case the numeral is "6", is printed in black, and is of a size and shape to match the numerals printed along the folder's edge. On each tab the numerals are printed in the first position in the aperture with the second position blank. The tab is foldable along line 42*e*** so as to define the two separate sections.

As can be seen, the first reference numeral **42*d* is printed along an axis parallel to the fold line 42*e* of the tab. The other reference numeral 42*f* is printed along an axis transverse to the fold line 42*e*** and transverse to the first numeral. Each marker tab is separable from the strip for application to the folder.

Tabs are provided for each of the numerals "0"–"9" and a unique color is associated with each numeral. The following table sets forth the color/numeral relationship. However, as can be appreciated, different colors may be used in the color-coding scheme:

0—Black
1—Orange
2—Blue
3—Green
4—Gold
5—Gray
6—Light Green
7—Red
8—Light Blue
9—Pink C. The Tab-Folder Combination Referring now to FIG. 5, it will be seen that in order to identify the file folder with the number "6091", only two color tabs are necessary. The digits can be represented as follows:

| 6 | 0 | 9 | 1 |
|---|---|---|---|
| Thousands | Hundreds | Tens | Units |

Figure 5:
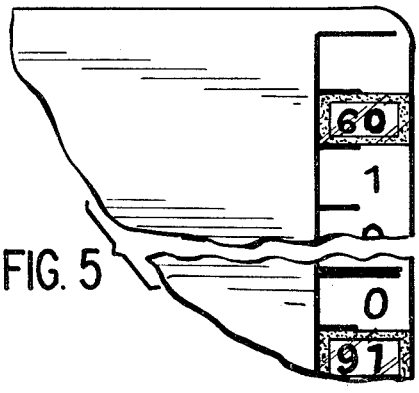
Figure 6:
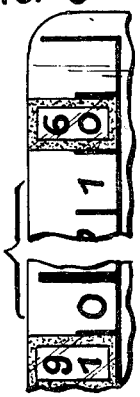
Figure 7:
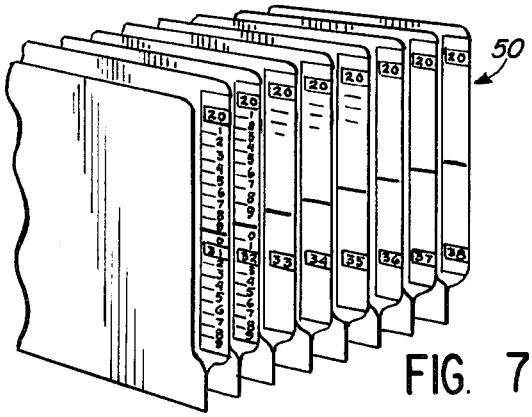
FIG. 7 is a perspective view showing several numerically filed folders in place in a shelf-type of filing system.

Referring now to FIGS. 5 and 6, the right-hand side edge 18, the units digit "1" is located on the folder in set 22. The tens digit "9" is obtained by applying the marker tab 47 having the number "9" on the folder so that the number "9" on the tab appears to the left of the number "1", whereby the numbers "9" and "1" appear in the window of the color tab. This is sometimes referred to as "9" over "1". Half of the tab is applied to the front of the folder so that the fold line generally aligns itself with the folder edge 18. The other half of the tab is applied to the back side of the folder as shown at FIG. 6 with the numbers "9" and "1" horizontally aligned.

In order to complete the number "6091", the hundreds digit "0" is located in the upper of the two indicia sets 24 and the color tab having a "6" thereon is applied to the folder so that the "6" appears adjacent the "0".

In viewing this system, it is read as "6091". As can be seen, the units and hundreds digits are represented by the upper and lower indicia bars, respectively, and the tens and thousands digits are represented by the tab. The foregoing explanation relates to a shelf-type of filing system.

Figure 4:
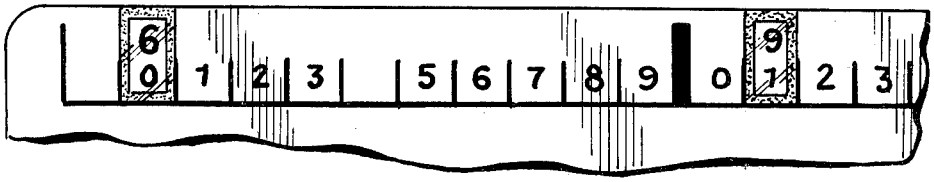
FIGS. 4–6 are fragmentary views of a file folder on which marker tabs have been applied to uniquely identify the file folder.

If the same numbers were to be used in a drawer-type filing system, the arrangement would be shown as in FIG. 4. In that case, rather than having the parallel numeral appear on the front, the transverse numeral is placed on the front. Referring to FIG. 4, that arrangement will be seen. If FIGS. 4 and 5 are compared, one sees the use of the transverse and parallel numerals.

Some users of the shelf-type filing systems use tub-type filing carts for refiling documents. In the tubs the side edge is not visible, but the top edge is. In such applications, tabs are applied to both the side and top edges.

The universality of this system can easily be appreciated since it can be used on either drawer or shelf-type of filing, or both.

Furthermore, in order to represent any four-digit number, only two color tabs are needed. This provides a 10,000 numeral system (i.e., 0000 to 9999). In the event that it would be desirable to have a five-digit number, an additional tab can be applied in the blank space 29 at the top or at the left-most end of the number bars.

The segment 50 of the shelf-filed folders is shown in FIG. 6. The folders are numbered "2031" through "2038". By simply viewing the folders, it can be seen that they are all in the two thousand series, and if there were a misfiling, it would be evident from both the color of the marker tabs and placement of the thousands and tens digits. The sequential filing of folders is also seen by virtue of the tens and units digits as they descend along the edge of the folder.

II. Alphabetic Filing Systems

A. The File Folder

The previously described system relates to numerical filing. However, alphabetical filing is frequently used. For example, in hospitals, doctors' offices, etc., files are arranged by a patients's last name, then first initial.

Referring now to FIG. 8, there are shown two file folders—one for the first half of the alphabet and another for the second half of the alphabet. The folder 100 is used for the first half of the alphabet and includes a front panel 102 and a back panel 104, which is slightly larger and having letters or alphabetic filing characters along the side edge 106 and the top edge 108. The letters "A" through "M" are printed on the top and side edges with the letters being positioned adjacent the side edge but spaced from the top edge. In both situations, the first position is blank. A two-position blank space, such as 107, is provided at each end of the alphabet bar.

The second folder 110 carries the second half of the alphabet, that is, the letters "N" through "Z". Blank spaces are provided before the "N" and after the "Z". In order to clearly identify the second folder as representing the second half of the alphabet, blackened sections 112 and 114 are applied to the folder adjacent the blank spaces so as to bracket the letter bar.

As previously indicated, for the English-language filing, the twenty-six characters of the English alphabet are used. However, the number of characters can be varied in accordance with other alphabets, such as Greek, Arabic, Russian, Hebrew, etc.

B. The Marker Tabs

Marker tabs similar to the numeric marker tabs described with reference to FIG. 3 are used with the principal differences being that rather than including ten numerals, there are tabs for twenty-six letters and there are thirteen associated colors. For the first half of the alphabet, the colored border completely surrounds the aperture. For the second half of the alphabet, the border is slotted at the outer edge so as to permit discrimination between the first half and the second half of the alphabet.

The following table sets forth the relationship of the colors to the letters:

| Letter | Color (Full Border) | Letter | Color (Slotted Border) |
|---|---|---|---|
| A | Orange | N | Orange |
| B | Blue | O | Blue |
| C | Green | P | Green |
| D | Gold | Q | Gold |
| E | Gray | R | Gray |
| F | Light Green | S | Light Green |
| G | Red | T | Red |
| H | Light Blue | U | Light Blue |
| I | Pink | V | Pink |
| J | Black | W | Black |
| K | Brown | X | Brown |
| L | Yellow | Y | Yellow |
| M | Purple | Z | Purple |

C. Tab-Folder Combination

Referring now to FIGS. 9 and 10, the first folder 100 is to be filed under the name of "Abbott, Joseph". In order to indicate "Abbott", a marker tab 116 having the letter "A" is applied to the folder over the printed letter "B". Thus the first two letters of the last name, "Abbott", are clearly indicated. If there is more than one person whose last name has as its first two letters "A", a marker tab 118 with the letter "J" can be applied in either of the blank space provided at the ends of the indicator bar. It is believed that the use of the lower space for the "J" is desirable. As can be seen, the letters can be applied either along the side or top edge or along both edges.

The folder 110 is designated for "Stone, Alan". It is seen that the marker tab 120 with the letter "S" is applied to the folder over the "T" so as to indicate "ST", and the marker tab 122 for the letter "A" is applied for "Alan" in the blank space. The border for the "S" tab is broken by a clear slot 120*a*.

In filing, all last names beginning with an "A" can be located by the color of the tab and then by the position of the tab for the second character "B", "C", "D", etc. As can be appreciated, the "A" filing system will run from "AA" to "AZ". Within that range there can be a provision for the first letter of the first name.

III. Summary

Based upon the foregoing, it is seen that in connection with the numeric system, a simple universal system has been provided for filing, retrieving and identifying misfiled files in both shelf and drawer systems. Two tabs in combination with the numeric indicia provide for filing of ten thousand documents, i.e., 0–9999. The system is expandable by adding additional numerals in the ten thousand space provided at the beginning of the indicia bar.

A similar system is provided for the alphabet.

It will also be noted that by having a large transparent window with a positive character printed thereon, that the character on the tab, as well as the character printed on the folder can be of the same size, color and shape, and thus provides for enhnaced visual appearance.

It will be appreciated that numerous changes and modifications can be made to the embodiment shown herein without departing from the spirit and scope of this invention.

What is claimed and desired to be secured by Letters Patent of the United States is:

1. A document to be uniquely identified for filing and retrieval, said document being adapted for use with colored marker tabs having filing characters thereon in a first position, said document having a front surface and a back surface and a top edge and side edge, and said front surface having an elongated filing character field adjacent said top edge and a side edge and sequential filing characters being positively applied along the top edge and side edge in each of said fields, and said back surface having a filing character field associated with the same side edge as the field on the front surface, and sequential filing characters being positively applied along the side edge in said field;

the filing characters in all fields being arranged to cooperate with a marker tab to form a two-character code with the character on the document being in the second position of the code; and wherein the field on the front surface, along the top edge extends inwardly from the edge at least two character heights;

the field on the front surface along the side edge extends inwardly of said edge at least two character widths; and said field on the back surface along the side edge extends inwardly at least two character heights;

whereby the filing characters on a marker tab can be cooperatively and selectively positioned on said document along a top or side edge to define a two-character filing code.

2. A document as in claim 1, wherein:

(a) the characters in the field on the front surface along the top edge are aligned transverse to said edge;

(b) the characters in the field on the front surface along the side edge are aligned parallel to said side edge; and (c) the characters in the field on the back surface along the side edge are aligned transverse to the edge.

3. A document as in claim 2, wherein:

(a) the characters in the field on the front surface along the top edge are spaced at least one character height from said edge so as to leave a space at least one character in height between the top edge and each character in said field;

(b) the characters in the field on the front surface along the side edge are adjacent said side edge so as to provide a space at least one character wide inwardly of each character in said field; and (c) the characters in the field on the back surface along the side edge are spaced at least one character height from said side edge so as to leave a space at least one character in height between the side edge and each character in said field being substantially aligned with the same character on the front surface along the side edge.

4. A document as in claim 1, wherein said document is a file folder having a front panel and a back panel and the fields being formed on the back panel, and the front panel being of a smaller size and recessed along the top edge and a side edge so that said fields along the top and side edge of the back panel's front surface are exposed for viewing.

5. A color-coded filing system which includes documents to be uniquely identified for filing and retrieval and marker tabs to be applied to said document wherein the document and each marker tab applied thereto cooperate to form a two-character code, and wherein the improvement comprises:

(a) the document having a panel and sequential filing characters positively applied at filing positions along the top and side edges so as to selectively permit either shelf or drawer type filing with the characters on the side edge positioned substantially adjacent the side edge and the characters associated with the top edge spaced downwardly therefrom, each of said characters taking the second of two positions in each of said filing positions, with the first position being blank;

(b) the marker tabs being adhesive-backed, transparent and having a colored peripheral border which defines a two-position transparent aperture and there being provided in the first position a positive filing character, and wherein the marker tab is constructed to be applied to the document in register with a filing character thereon so that a character on said document appears in the second position in the aperture and thus forms a two-character filing code; and (c) the characters appearing in the aperture are all of a similar size, shape and color so as to provide a unique and visually desirable identification for said document.

6. A filing system as in claim 5, wherein the characters on the document are aligned generally parallel to the side edge and transverse to the top edge and the marker tab being foldable along a fold or hinge line with apertures being defined on each side of said hinge and in which the first position characters in each aperture are aligned with one being parallel and the other being transverse to the hinge line, for selective cooperation with the top edge or side edge of the document whereby the document and tab characters appearing in the aperture within the colored border have the same alignment.

7. A filing system as in claim 5, wherein said filing characters are numerals.

8. A filing system as in claim 7, wherein said numerals on said document are arranged in numbered bars and each numbered bar has two sets of filing numerals, each set having each of the numerals "0"–"9" and each set of numerals in the numbered bar being separated by a spacer bar.

9. A filing system as in claim 8, wherein the document has two numbered bars along each edge and at least two marker tabs are applied along one edge, one tab for each set of numerals, so that numbers as great as "9999" can be identified using two numbered bars and two tabs.

10. A filing system as in claim 5, wherein said alphabet is the English alphabet and said document has applied thereto a set of thirteen letters of said alphabet, the set being selected from the group constituting the letters "A"–"M" or "N"–"Z", with the set "N"–"Z" having darkened markers at each end of said letters so as to bracket said letters.

11. A filing system as in claim 5, wherein a marker tab is applied to each of the top edge and the side edge so as to identify the same filing code on the top and side edges and thus permit drawer and shelf filing of the same document.

12. A filing system as in claim 5, wherein there are provided sequential filing characters on the back of said panel along the side edge thereof, said characters being spaced from the side edge and each character being aligned transverse to the side edge and generally with the same characters on the face of said panel.

13. A filing system as in claim 6, wherein said tab is constructed such that when the tab fold line is applied along the side edge of a document the parallel character is in parallel alignment with the side edge of said document.

14. A filing system as in claim 6, wherein said tab is constructed such that when the tab fold line is applied along the top edge of a document the transverse character is aligned transverse to said top edge of said document.

15. A filing system as in claim 6, wherein in one aperture of the tab the filing character is adjacent the fold line and in the other aperture the filing character is remote from said fold line.

16. A filing system as in claim 15, wherein said transverse character is adjacent the fold line.

17. A filing system as in claim 5, wherein said document is a filing folder.

18. A marker tab for use with documents to be filed in a color-coded filing system, wherein each tab is elongated, foldable along a fold or hinge line and includes a transparent substrate, there being provided an adhesive on one side of said substrate and the other side of said substrate having a color and filing characters carried thereon, said color defining a peripheral border on each side of said fold line which, in turn, defines a two-position central transparent aperture on each side of said fold line and there being provided a positively applied filing character in the first position of each of said apertures and the second position being left blank, and said color and filing character being uniquely related to each other, and wherein the filing characters include a first set of characters and a second set of characters, and wherein the peripheral border for one of said sets is continuous and the peripheral border for the other of said sets is slotted, so as to permit visual discrimination between said sets.

19. A marker tab as in claim 18, wherein said filing characters are the letters of the English alphabet, and wherein one of said sets includes the letters "A"–"M" and the other of said sets includes the letters "N"–"Z".

20. A marker tab as in claim 19, wherein the set "A'-'–"M" has a continuous border and the set "N"–"Z" has a slotted border.

21. A marker tab for use with documents to be filed in a color-coded filing system, wherein each tab is elongated, foldable along a fold or hinge line and includes a transparent substrate having an adhesive, a color and filing characters provided thereon, said color defining a peripheral border on each side of said fold line and defining a two-position central transparent aperture on each side of said fold line and there being provided a positively applied filing character in the first position of each of said apertures and the second position being left blank, and said color and filing characters being uniquely related to each other;

one of said filing characters being aligned substantially parallel to the fold line and the other filing character being aligned substantially transverse to the fold line; and wherein the aperture having the parallel filing character has a height equal to the height of at least one character and a length equal to the width of at least two characters and the aperture having the transverse filing character has a height equal to at least the width of one character and a length equal to at least the length of two characters;

whereby the second blank position in each aperture is of a size which permits exposure therethrough of a second filing character of substantially the same size and orientation as the character on the filing tab.

22. A tab as in claim 21, wherein said apertures are of substantially the same size.

23. A tab as in claim 21, wherein the filing characters are the letters of an alphabet.

24. A tab as in claim 21, wherein the filing characters are numerals.

25. A tab as in claim 21, wherein in one aperture of the tab the filing character is in the position adjacent the fold line and in the other aperture the filing character is in the position remote from the fold line.

26. A tab as in claim 25, wherein the transverse filing character is in the position adjacent the fold line.

* * * * *